US005657634A

United States Patent [19]

Woods

[11] Patent Number: 5,657,634

[45] Date of Patent: Aug. 19, 1997

[54] CONVECTION COOLING OF BELLOWS CONVOLUTIONS USING SLEEVE PENETRATION TUBE

[75] Inventor: Daniel C. Woods, Florence, S.C.

[73] Assignee: General Electric Company, Milwaukee, Wis.

[21] Appl. No.: 580,106

[22] Filed: Dec. 29, 1995

[51] Int. Cl.[6] ..... F25B 19/00

[52] U.S. Cl. ..... 62/51.1; 165/185; 165/156

[58] Field of Search ..... 62/51.1; 165/185, 165/156

[56] References Cited

U.S. PATENT DOCUMENTS 4,926,646 5/1990 Dorri et al. ..... 62/51.1

*Primary Examiner*—Ronald C. Capossela
*Assistant Examiner*—Pamela A. O'Connor
*Attorney, Agent, or Firm*—Dennis M. Flaherty; John H. Pilarski

[57] ABSTRACT

A sleeve assembly for reducing the thermal conduction heat load from the bellows penetration tube to the heliumvessel of a superconducting magnet assembly. The sleeve assembly is designed to force helium boil-off gas to flow in intimate contact with the bellows convolutions. The helium boil-off gas thereby intercepts or removes a portion of the heat that would normally be conducted from the bellows convolutions to the helium vessel. The sleeve assembly consists of a circular cylindrical rolled tube made of laminated thermosetting material. The outer diameter of the tube is wrapped with tape in a helical pattern. The diameter of the sleeve and the thickness of the tape wrapping are selected so that the outer circumferential surface of the helically wrapped tape abuts the inner diameter of the bellows. The sleeve is fabricated with a relatively small thickness to minimize thermal con-duction load. The successive turns of the helical strip of tape are separated by a helical channel which forms a helical flow path for the helium boil-off gas as it flows toward the boil-off gas outlet. As the helium gas spirals around the sleeve assembly, the gas cools the bellows convolutions and the sleeve instrumentation wiring, thereby minimizing thermal conduction losses. Also, the gas will travel inside the bellows convolutions to minimize helium gas conduction inside the convolutions.

20 Claims, 4 Drawing Sheets

CONVECTION COOLING OF BELLOWS CONVOLUTIONS USING SLEEVE PENETRATION TUBE

FIELD OF THE INVENTION

This invention relates to cryostat construction, and in particular, to the construction of cryostats for containing coolants such as liquid helium used to cool superconductive magnet coils in a magnetic resonance imaging system.

BACKGROUND OF THE INVENTION

As is well known, a coiled magnet, if wound with wire possessing certain characteristics, can be made superconducting by placing it in an extremely cold environment, such as by enclosing it in a cryostat or pressure vessel containing liquid helium or other cryogen. The extreme cold reduces the resistance in the magnet coils to negligible levels, such that when a power source is initially connected to the coil (for a period, for example, of 10 minutes) to introduce a current flow through the coils, the current will continue to flow through the coils due to the negligible resistance even after power is removed, thereby maintaining a magnetic field. Superconducting magnets find wide application, for example, in the field of magnetic resonance imaging (hereinafter "MRI").

A known superconducting magnet system comprises a circular cylindrical magnet cartridge having a plurality (e.g., three) of pairs of superconducting magnet coils; a toroidal inner cryostat vessel ("helium vessel") which surrounds the magnet cartridge and is filled with liquid helium for cooling the magnets; a toroidal low-temperature thermal radiation shield which surrounds the helium vessel; a toroidal high-temperature thermal radiation shield which surrounds the low-temperature thermal radiation shield; and a toroidal outer cryostat vessel ("vacuum vessel") which surrounds the high-temperature thermal radiation shield and is evacuated.

Since it is necessary to provide electrical energy to the main magnet coils, to various correction coils and to various gradient coils employed in MRI systems, there must be at least one penetration through the vessel walls. These penetrations must be designed to minimize thermal conduction between the vacuum vessel and the helium vessel, while maintaining the vacuum in the toroidal volume between the vacuum and helium vessels. In addition, the penetrations must compensate for differential thermal expansion and contraction of the vacuum and helium vessel. The penetration also serves as a flow path for helium gas in the event of a magnet quench, i.e., a magnet losing its superconductive state.

It is known to use a bellows as the magnet penetration tube. The convolutions of the bellows provide for additional thermal length (typically four times the straight length). However, even with the additional thermal length provided by the convolutions, the thermal conduction load from the bellows to the helium vessel can be significant (10–15% of the total heat load in some designs). Since it is the goal of the cryostat designer to minimize system boil-off, any reduction of the heat load can result in significant life-cycle cost reductions due to reduced helium consumption. Thus, there is a need to incorporate structural design features which reduce the heat load from the bellows to the helium vessel.

SUMMARY OF THE INVENTION

The present invention is an assembly for facilitating the penetration of electrical leads from a point outside of the vacuum vessel to a point inside the helium vessel with reduced thermal conduction heat load from the bellows penetration tube to the helium vessel. In accordance with the present invention, this is accomplished by installing an integral sleeve assembly inside the bellows convolutions. This integral sleeve assembly has a design which forces helium boil-off gas, which tends to flow toward a boil-off gas outlet, to flow in intimate contact with the bellows convolutions. The helium boil-off gas thereby intercepts or removes a portion of the heat that would normally be conducted from the bellows convolutions to the helium vessel.

In accordance with the preferred embodiment of the invention, the sleeve assembly comprises a circular cylindrical rolled tube made of laminated thermosetting material. The outer diameter of the tube is wrapped with tape in a helical pattern. The diameter of the sleeve and the thickness of the tape wrapping are selected so that the outer circumferential surface of the helically wrapped tape abuts the inner diameter of the bellows. The sleeve is fabricated with a relatively small thickness to minimize thermal conduction load. The successive turns of the helical strip of tape are separated by a helical channel which forms a helical flow path for the helium boil-off gas as it flows toward the boil-off gas outlet. As the helium gas spirals around the sleeve assembly, the gas cools the bellows convolutions, thereby minimizing thermal conduction losses. Also, the gas will travel inside the bellows convolutions to minimize helium gas conduction inside the convolutions.

As a result of the present invention, the helium boil-off gas has a small flow cross-sectional area. This small flow area increases the velocity of the helium gas, thereby increasing the convective heat transfer coefficient.

The sleeve assembly also has instrumentation wiring (level sensors, diodes, etc.) attached along the inner diameter of the tube. In this way the sleeve assembly serves a dual purpose as the helium gas that cools the bellows convolutions also cools the instrumentation wiring for the sleeve assembly.

DETAILED DESCRIPTION OF THE PREFERRED EMBODIMENTS

Figure 1:
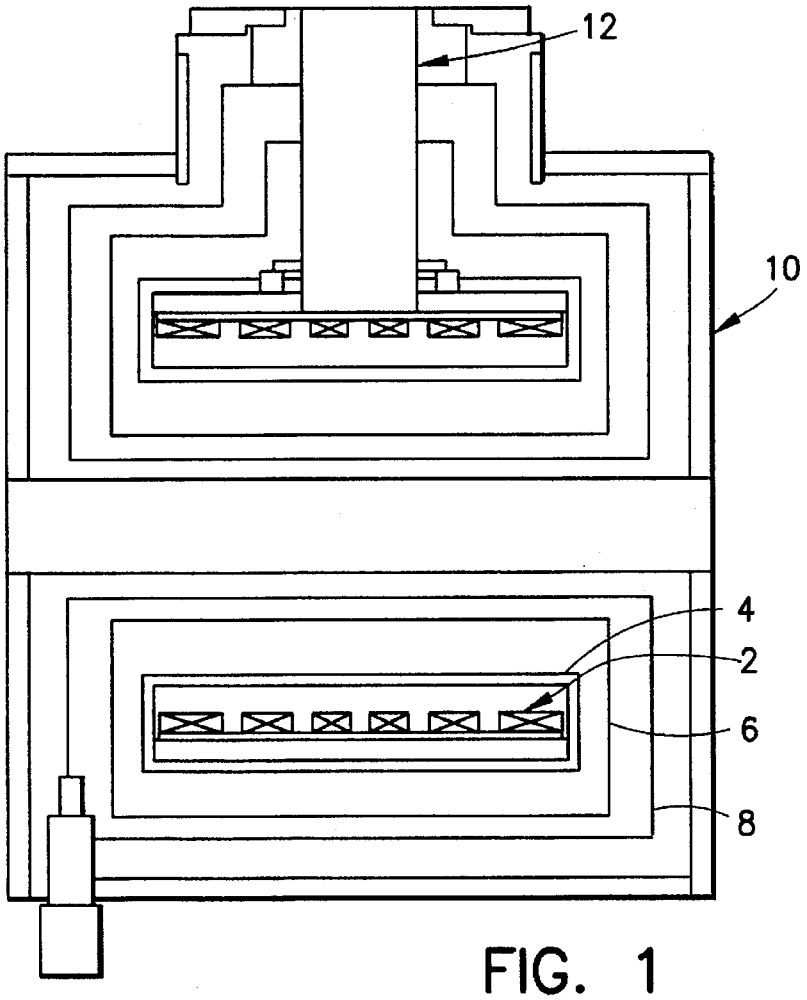
FIG. 1 is a schematic diagram depicting a sectional view of a conventional cryostat for a superconducting magnet assembly, the section being taken along an axial midplane of the assembly.

Referring to FIG. 1, a known superconducting magnet system comprises a circular cylindrical magnet cartridge 2 having a plurality (e.g., three) of pairs of superconducting magnet coils (not shown); a toroidal helium vessel 4, which surrounds the magnet cartridge 2 and is filled with liquid helium for cooling the magnets; a toroidal low-temperature thermal radiation shield 6, which surrounds the helium vessel 4; a toroidal high-temperature thermal radiation shield 8 which surrounds the low-temperature thermal radiation shield 6; and a toroidal vacuum vessel 10, which surrounds the high-temperature thermal radiation shield 8 and is evacuated. To provide electrical energy to the main magnet coils, to various correction coils and to various gradient coils employed in MRI systems, the various electrical leads must pass through the vessel walls from the outside of the vacuum vessel. This is conventionally accomplished by means of a penetration tube assembly 12, which penetrates the helium and vacuum vessels and the radiation shields, thereby providing access for the electrical leads.

Figure 2:
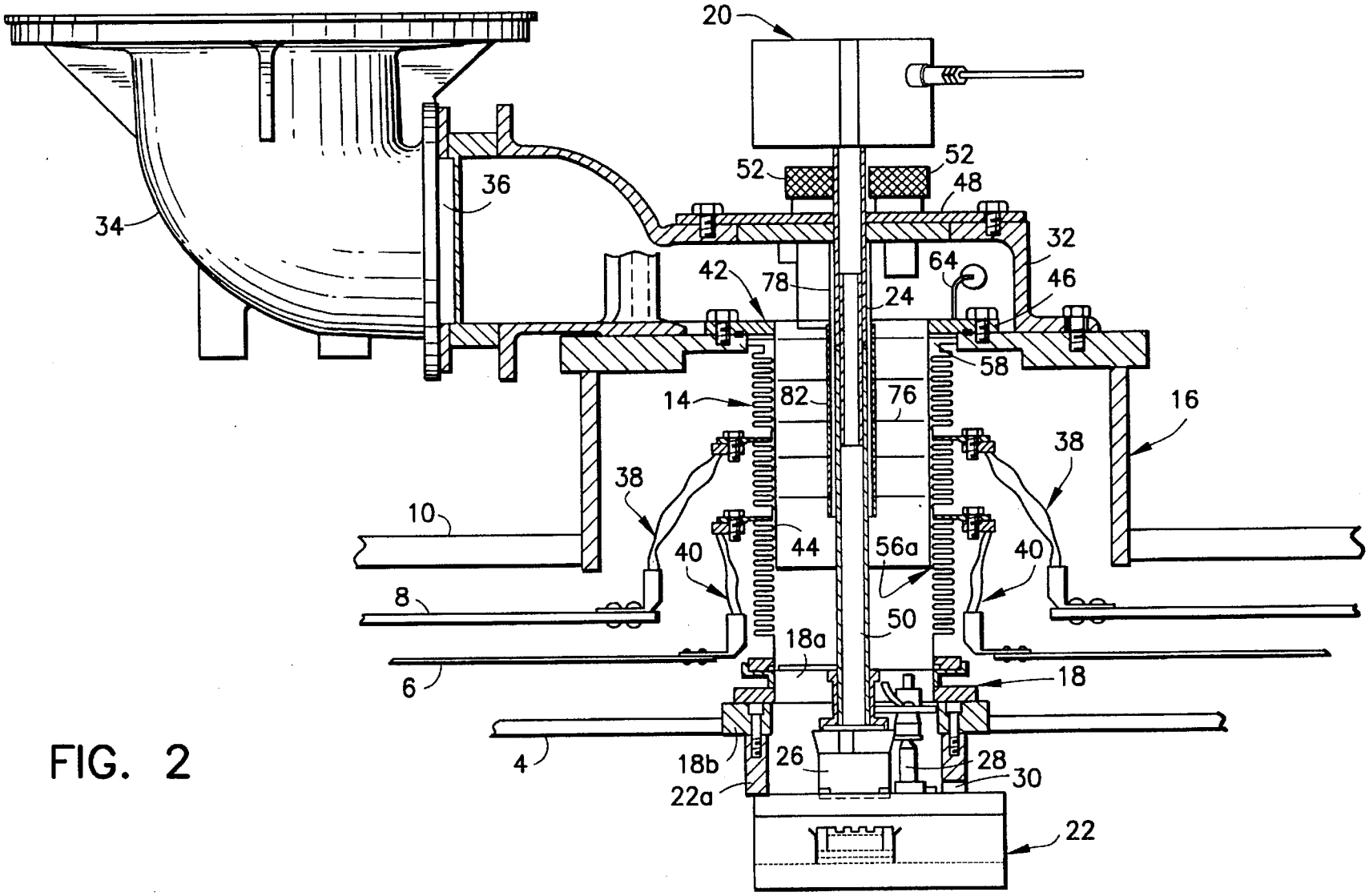
FIG. 2 is a schematic diagram depicting a sectional view of a penetration tube assembly in accordance with a preferred embodiment of the invention, the section being taken along a radial plane perpendicular to the axial midplane section of FIG. 1.
Figure 8:
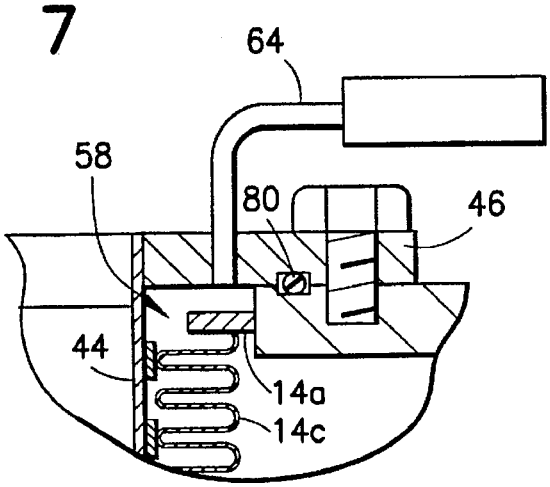
FIG. 8 is a schematic diagram depicting a sectional view of the portions of the sleeve assembly and bellows attached to the penetration support housing in accordance with the preferred embodiment of the invention.

As shown in more detail in FIG. 2, a conventional penetration tube assembly comprises an axially expandable structure such as a stainless steel bellows 14. A flange **14*a* at the upper end of bellows 14 is bolted to a flange of a penetration support housing 16 (see FIG. 8), which is in turn mounted on the vacuum vessel 10. A flange 14*b* at the lower end of bellows 14 is joined to a transition piece 18, which is in turn mounted in an opening in the helium vessel 4. To facilitate the joining of the bellows and the helium vessel, which are made of stainless steel and aluminum alloy respectively, the transition piece consists of a central portion 18*a* made of stainless steel and a peripheral portion 18*b* made of aluminum alloy. The stainless steel portion 18*a* is friction welded to flange 14*b* of the stainless steel bellows. The aluminum alloy portion 18*b* is welded to the aluminum alloy helium vessel 4**.

Figure 3:
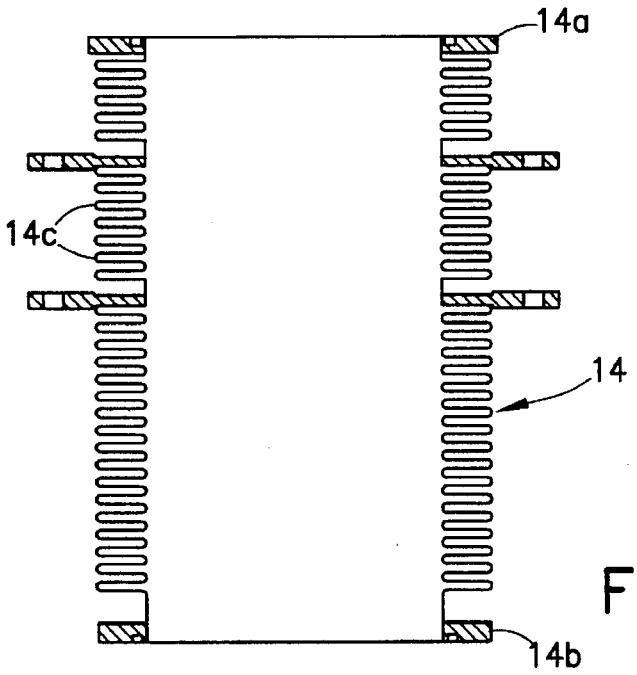
FIG. 3 is a schematic diagram depicting a sectional view of the bellows incorporated in the penetration tube assembly shown in FIG. 2.

As shown in FIG. 3, the bellows 14 comprises a multiplicity of convolutions **14*c*. The bellows is designed so that the convolutions are flexible. The bellows convolutions flex to allow the lower bellows flange 14*b* to move independently of the upper bellows flange 14*a*. This arrangement allows for relative movement between the helium vessel 4 and the vacuum vessel 10**, e.g., due to differential thermal contraction or during transport of the superconducting magnet assembly.

To facilitate the connection of the correction coils (located inside the helium vessel and not shown) to the shim lead assembly 20, a connector platform 22 is bolted to the bottom portion **18*b* of the transition piece 18. The shim leads are housed in a tube assembly comprising a shim tube 24 epoxied to a stainless steel tube 50. The shim leads are connected to the connector platform 22 via a connector 26. Power leads enter plenum 34 via power lead ports 52 and are connected to connector platform 22 via a connector 28**.

It is conventional practice to partition the interior volume of the bellows 14 horizontally using a so-called "baffle tree" comprising a plurality of thin annular baffles 76 which are epoxied to a baffle support tube 78 made of laminated thermosetting material (such as G10 material, described in detail hereinbelow) and spaced vertically by means of a plurality of circular cylindrical spacers 82, also epoxied to baffle support tube 78. The baffle support tube 78 surrounds portions of tubes 24 and 50 and is supported at its top end by a mounting on the cover plate 48. Each baffle 76 is made of Mylar sheet. The baffles partition the bellows interior volume so that the helium gas in the penetration tube is thermally stratified and thermal radiation from the cover plate 48 to the connector platform 22 is reduced. In the event of a magnet quench, these baffles are blown open by the helium gas pressure and dynamic flow, allowing the helium gas to exit the cryostat via the penetration tube.

The connector platform 22 has a circular cylindrical portion **22*a* by which the platform is bolted to the transition piece. The wall of portion 22*a* has at least one opening 30 via which the internal volume of the helium vessel 4 is in fluid communication with the interior of the penetration tube. Thus, opening 30 provides a flow path for helium boil-off gas. In the event of a magnet quench, the liquid helium turns to gas suddenly and escapes from the helium vessel. The helium gas deflects baffles 76 and fills the interior volume of a plenum 32, which is mounted on top of the penetration support housing 16. In the absence of a magnet quench, fluid communication between the interior volume of plenum 32 and a vent adaptor 34 is blocked by a burst disk 36, which is designed to rupture when the helium gas pressure inside the plenum volume reaches a predetermined threshold. The helium gas then escapes out a vent pipe (not shown) which is attached to vent adaptor 34**.

As seen in FIG. 2, the bellows are thermally coupled to the high-temperature thermal radiation shield 8 via a plurality of flexible copper braids 38; and are thermally coupled to the low-temperature thermal radiation shield 6 via a plurality of flexible copper braids 40. The thermal radiation shields are in turn thermally coupled to a cryocooler (not shown). It is desirable that heat in the bellows be conducted to the thermal shields via copper braids 38 and 40, rather than be conducted to the helium vessel 4. However, in conventional penetration tube designs, the thermal conduction load from the bellows to the helium vessel is significant. The conduction of heat from the bellows to the helium vessel contributes to helium gas boil-off.

In accordance with the present invention, the thermal conduction load from the bellows to the helium vessel is reduced by installing an integral sleeve assembly 42 inside the bellows convolutions. This sleeve assembly has a design which forces helium boil-off gas, which tends to flow upward toward a boil-off gas outlet, to flow in intimate contact with the bellows convolutions. The helium boil-off gas thereby intercepts or removes a portion of the heat that would normally be conducted from the bellows convolutions to the helium vessel.

Figure 4:
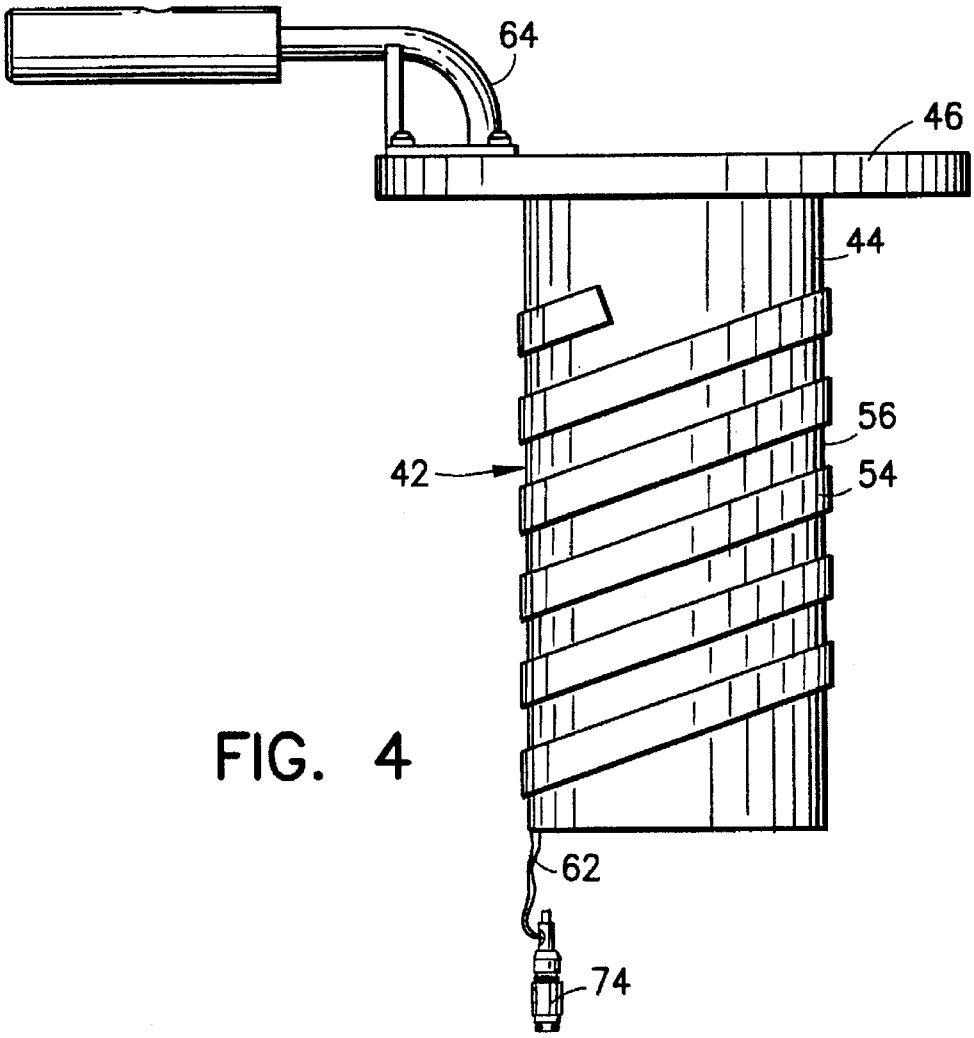
FIG. 4 is a schematic diagram depicting a side view of the sleeve assembly incorporated in the penetration tube assembly shown in FIG. 2.

Referring to FIG. 4, the sleeve assembly 42 comprises a circular cylindrical tube 44, and an annular flange 46 connected to one end of tube 44. The flange 46 is made of aluminum. The sleeve assembly is mounted by bolting flange 46 to the flange of the penetration support housing 16 with an O-ring seal 80 therebetween (see FIG. 8). Flange 46 has an inner diameter slightly greater than the outer diameter of tube 44. The upper end of tube 44 is attached to the inner diameter of flange 46 by means of epoxy such that the tube axis is perpendicular to the plane of flange 46 and coaxial with the axis of the bellows.

Tube 44 is fabricated with a relatively thin wall (typically 65 mils thick) to minimize the thermal conduction load. In accordance with the preferred embodiment, tube 44 is a rolled tube made of laminated thermosetting material. For example, one suitable laminated thermosetting material is grade G10, which is a continuous filament-type glass cloth laminated using epoxy binder. Rolled tubes of G10 material are made of laminations of fibrous sheet impregnated material, rolled upon mandrels under tension or between heated pressure rolls, or both, and oven-baked after rolling on the mandrels. Grade G10 material has extremely high mechanical strength (flexural, impact and bonding) at room and cryogenic temperatures, and good dielectric loss and dielectric strength properties under dry and humid conditions. In accordance with the preferred embodiment of the invention, the outer diameter of tube 44 is wrapped with layers of tape 54 in a helical pattern. The diameter of the sleeve and the thickness of the tape wrapping are selected so that the outer circumferential surface of the helically wrapped tape abuts the inner diameter of the bellows. For example, the wrapped tape may be two layers of 7-mil-thick Permacel tape, which is a cloth (fiber) based tape. In this instance, the successive turns of the helical strip of tape will be separated by a helical channel 56 having a depth of 14 mils. The softness of the cloth-based tape allows it to act as a gasket. The tape will "seal" next to the bellows convolution to create a flowpath for helium gas.

Figure 6:
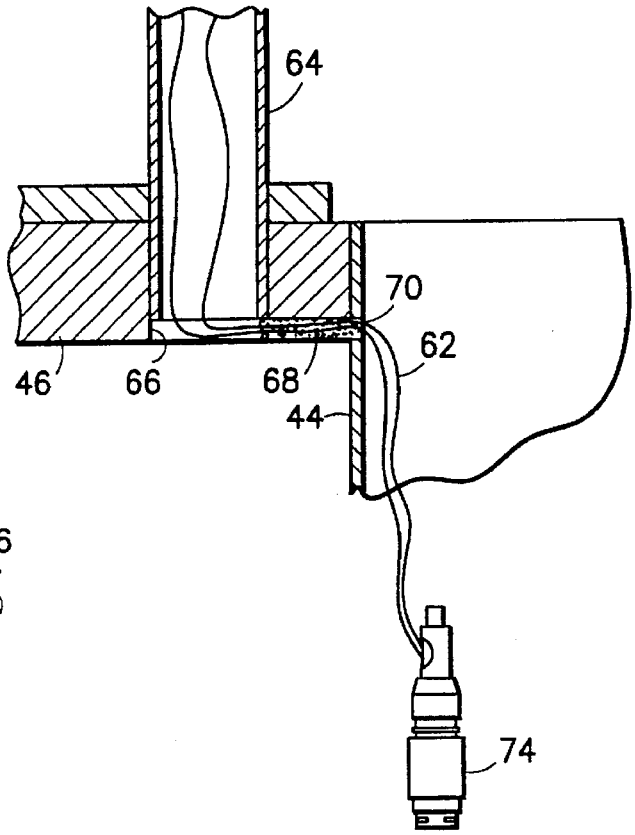
FIG. 6 is a schematic diagram depicting a sectional view of the sleeve assembly in accordance with the preferred embodiment of the invention.

Referring to FIG. 2, the channel 56 forms a helical path for helium boil-off gas to spiral upward from boil-off gas inlet 56*a* (i.e., at the start of helical channel 56) to the volume 58 separating the bellows flange 14*a* and the sleeve assembly flange 46. Volume 58 is shown in detail in FIG. 8. As seen in FIG. 6, flange 46 has a vertical circular hole 66 for receiving one end of a vent tube 64. The other end of vent tube 64 is connected to a boil-off gas outlet which penetrates the plenum 36 and communicates with the ambient atmosphere. Hole 66 is in flow communication with volume 58. Helium boil-off gas which reaches the volume 58 will flow to the boil-off gas outlet via the vent tube 64.

Figure 5:
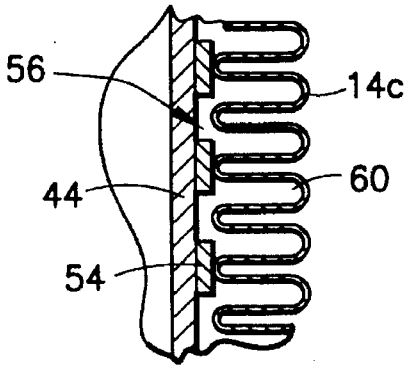
FIG. 5 is a schematic diagram depicting a sectional view of a portion of the helical gas flow path formed by the sleeve assembly in accordance with the preferred embodiment of the invention.

As seen in FIG. 5, the helical channel 56 is in flow communication with volumes 60 inside the bellows convolutions. As the helium boil-off gas spirals around the sleeve assembly, the gas will also flow inside the volumes 60, thereby minimizing helium gas conduction inside the convolutions. Typically, analysis has shown that helium gas conduction in the convolutions is 50% of the heat load arising from heat conduction along the convolution length.

A prototype sleeve assembly was fabricated and tested in a typical bellows tube in a superconductive magnet. Test results indicate a boil-off reduction of 0.02 liter/hr with the sleeve assembly installed versus not installed. Therefore, installation of a sleeve assembly in accordance with the present invention can result in a 10% reduction in boil-off for a system having a boil-off specification of 0.2 liter/hr.

Figure 7:
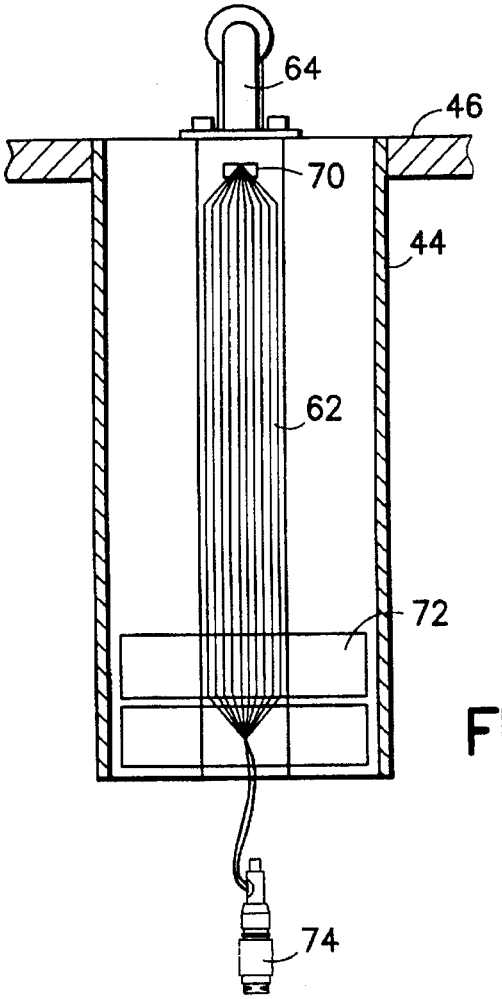
FIG. 7 is a schematic diagram depicting a sectional view of a portion of the sleeve assembly of FIG. 6, showing the instrumentation wiring penetration in detail.

Referring to FIG. 6, in accordance with a further aspect of the invention, the sleeve assembly has instrumentation wiring 62 (e.g., for level sensors and magnet heaters) attached along the inner diameter of tube 44. As the helium gas spirals upward in the volume between the sleeve and the bellows, the helium gas that cools the bellows convolutions also cools the instrumentation wiring 62. Referring to FIG. 7, the wiring 62 runs vertically through vent tube 64 and horizontally through a channel 68 formed on the bottom face of flange 46 and a hole 70 formed in tube 44. The channel 68 is filled with epoxy to hold the wires in place. Upon exiting hole 70, the wires 62 fan out and continue their vertical descent in parallel along the inner diameter of tube 44, as seen in FIG. 7, and are epoxied along the inner diameter of tube 44 using a cryogenic epoxy. Fiberglas cloth 72 saturated with cryogenic epoxy is used to hold the wires 62 against the tube inner diameter. The wiring 62 ends in a connector 74, to which the connector (not shown) of the instrument is coupled.

The preferred embodiment of the invention has been disclosed for the purpose of illustration. Variations and modifications which do not depart from the broad concept of the invention will be readily apparent to those skilled in the construction of cryostat penetration tubes. For example, the number of tape layers can be varied depending on the thickness of the tape and the desired depth of the helical channel. In addition, although the disclosed preferred embodiment has a single helical tape wrapping, it will be apparent that more than one helix can be wrapped in parallel around the tube outer diameter to create multiple helical flow paths for the helium boil-off gas. All such variations and modifications are intended to be encompassed by the claims set forth hereinafter.

I claim:

1. A sleeve assembly comprising:

a circular cylindrical tube having an axis, an upper end, a lower end, an outer circumferential surface and an inner circumferential surface;

an annular flange attached to said upper end of said tube and generally perpendicular to said axis; and a helical raised structure attached to said outer circumferential surface of said tube, said helical raised structure defining a helical channel, wherein said flange is made of metal alloy and said tube is made of nonmetallic material.

2. The sleeve assembly as defined in claim 1, wherein said tube is made of laminated thermosetting material.

3. The sleeve assembly as defined in claim 2, wherein said laminated thermosetting material is a continuous filament-type glass cloth laminated using epoxy binder.

4. The sleeve assembly as defined in claim 1, wherein said annular flange has an inner diameter and said upper end of said tube is secured inside said inner diameter of said flange by epoxy.

5. The sleeve assembly as defined in claim 1, wherein said helical raised structure comprises helically wound tape.

6. The sleeve assembly as defined in claim 1, further comprising instrumentation wiring which is attached to said inner circumferential surface of tube and which penetrates an aperture in said tube.

7. A penetration tube assembly for a superconducting magnet system having a helium vessel surrounded by a vacuum vessel, comprising:

a penetration support housing attached to said vacuum vessel;

a transition piece attached to helium vessel;

an axially contractable structure having an upper end attached to said penetration support housing and a lower end attached to said transition piece; and a sleeve assembly comprising a circular cylindrical tube having an axis, an upper end, a lower end, an outer circumferential surface and an inner circumferential surface, and an annular flange attached to said upper end of said tube and generally perpendicular to said axis, wherein said flange is made of metal alloy and said tube is made of nonmetallic material, said flange of said sleeve assembly being attached to said penetration support housing and said tube extending inside said axially contractable structure, said outer circumferential surface of said tube being separated from said axially contractable structure.

8. The penetration tube assembly as defined in claim 7, wherein said axially contractable structure comprises a bellows.

9. The penetration tube assembly as defined in claim 7, wherein said sleeve assembly further comprises a helical raised structure attached to said outer circumferential surface of said tube, said helical raised structure defining a helical channel.

10. The penetration tube assembly as defined in claim 9, further comprising a vent tube inserted in a hole in said flange which is in flow communication with said helical channel.

11. The penetration tube assembly as defined in claim 7, wherein said tube is made of laminated thermosetting material.

12. The penetration tube assembly as defined in claim 10, wherein said laminated thermosetting material is a continuous filament-type glass cloth laminated using epoxy binder.

13. The penetration tube assembly as defined in claim 7, wherein said helical raised structure comprises helically wound tape.

14. The penetration tube assembly as defined in claim 7, further comprising instrumentation wiring which is attached to said inner circumferential surface of tube and which penetrates a hole in said tube and a hole in said flange.

15. A superconducting magnet system comprising:

a generally toroidal vacuum vessel;

a generally toroidal high-temperature thermal shield surrounded by said vacuum vessel;

a generally toroidal low-temperature thermal shield surrounded by said high-temperature thermal shield;

a generally toroidal helium vessel surrounded by said low-temperature thermal shield;

a superconducting magnet coil surrounded by said helium vessel; and a penetration tube assembly for passing electrical wiring from outside said vacuum vessel to inside said helium vessel, wherein said penetration tube assembly comprises:

a penetration support housing attached to said vacuum vessel;

a transition piece attached to helium vessel;

a bellows having an upper end attached to said penetration support housing and a lower end attached to said transition piece; and a sleeve assembly comprising a circular cylindrical tube having an axis, an upper end, a lower end, an outer circumferential surface and an inner circumferential surface, and an annular flange attached to said upper end of said tube and generally perpendicular to said axis, wherein said flange is made of metal alloy and said tube is made of nonmetallic material, said flange of said sleeve assembly being attached to said penetration support housing and said tube extending inside said bellows, said outer circumferential surface of said tube being separated from said bellows.

16. The superconducting magnet system as defined in claim 15, wherein said sleeve assembly further comprises a helical raised structure attached to said outer circumferential surface of said tube, said helical raised structure defining a helical channel.

17. The superconducting magnet system as defined in claim 16, wherein said tube is made of laminated thermosetting material.

18. The superconducting magnet system as defined in claim 16, wherein said helical raised structure comprises helically wound tape.

19. The superconducting magnet system as defined in claim 16, further comprising a vent tube inserted in a hole in said flange which is in flow communication with said helical channel.

20. The superconducting magnet system as defined in claim 15, further comprising instrumentation wiring which, is attached to said inner circumferential surface of tube and which penetrates a hole in said tube and a hole in said flange.

* * * * *